United States Patent [19]

Stahlecker

[11] 4,155,217

[45] May 22, 1979

[54] MOBILE CLEANING DEVICE FOR AN OPEN-END SPINNING MACHINE

[75] Inventor: Fritz Stahlecker, Josef-Neidhart-Strasse 18, 7341 Bad Überkingen, Fed. Rep. of Germany

[73] Assignees: Hans Stahlecker; Fritz Stahlecker, both of Fed. Rep. of Germany

[21] Appl. No.: 798,380

[22] Filed: May 19, 1977

[30] Foreign Application Priority Data

May 20, 1976 [DE] Fed. Rep. of Germany ..... 2622627

[51] Int. Cl.[2] ..... D01H 11/00; D01H 7/00

[52] U.S. Cl. ..... 57/302; 57/304

[58] Field of Search ..... 57/56, 58.89; 15/301, 15/312 R, 316 R, 406, 414

[56] References Cited

U.S. PATENT DOCUMENTS

| | | | |
|---|---|---|---|
| 3,524,312 | 8/1970 | Landwehrkamp | 57/58.89 X |
| 3,597,911 | 8/1971 | Schiltknecht et al. | 57/56 |
| 3,662,532 | 5/1972 | Stahlecker | 57/58.89 |
| 3,810,352 | 5/1974 | Miyazaki et al. | 57/56 X |
| 4,028,136 | 6/1977 | Kamp | 57/56 X |

*Primary Examiner*—Donald Watkins

*Attorney, Agent, or Firm*—Craig and Antonelli

[57] ABSTRACT

A mobile service device is provided for servicing spinning assemblies of an open-end spinning machine. The servicing device carries cleaning apparatus including a cleaning brush, a drive motor for rotatably driving the cleaning brush around its support shaft, and a selectively movable lever mechanism for moving the brush into and out of a penetrating position in a spinning rotor. Preferred embodiments of the invention include cleaning brushes having a diameter smaller than the open side of a spinning rotor to be cleaned, with the cleaning brush and its support shaft being carried by a crank mechanism for moving the shaft and brush in a circular motion so as to assure engagement of the brush with the yarn collecting groove in the spinning rotor being cleaned.

14 Claims, 5 Drawing Figures

MOBILE CLEANING DEVICE FOR AN OPEN-END SPINNING MACHINE

BACKGROUND AND SUMMARY OF THE INVENTION

The invention relates to a servicing device that can be moved along an open end spinning frame of the type having a plurality of open-end spinning assemblies. The servicing device includes means for opening the spinning assemblies and means for associating a cleaning device with the open ends of the respective spinning rotors which are made accessible by the opening of respective spinning assemblies.

In a known construction (German AS No. 2,008,142, FIGS. 3 and 4) a suction tube is provided as a cleaning device, on which a stripping element made as a spring or the like is disposed. In this construction use is made of the circumstance that the spinning rotor continues to run during the cleaning process because of its mass inertia, so that it passes by the stripping blade or element with its surfaces that are to be cleaned. A cleaning device of this kind cannot be used if the spinning rotor has already been stopped. This stopping of the spinning rotor occurs automatically in many known open-end spinning frames, upon the opening of the spinning assembly in question. In most cases there is a brake which stops the rotor.

A suction device is known (German Gebrauchsmuster No. 7,523,558) for a primarily manual cleaning of a spinning rotor, said device presenting a mouth piece that has a crownlike widening at its free end, which has projections that can be introduced into a yarn collecting groove of a spinning rotor. This crownlike widening can consist of stiff bristles. This cleaning device also can function only if the spinning rotor turns during the cleaning operation.

Automatic opening of a spinning assembly and subsequent introduction of a cleaning device which has a cleaning brush into the spinning rotor, when there is a yarn break, is also known, corresponding to U.S. Pat. No. 3,662,532 (German OS No. 1,933,930). Here also there is the condition that the spinning rotor will still turn during the cleaning process, because otherwise there will be no cleaning.

The invention is addressed to the problem of creating a servicing device that can clean a spinning rotor of a spinning assembly when the rotor is no longer turning. The invention contemplates that the cleaning device has a brush that penetrates into the rotor, which brush is provided with a drive for execution of the cleaning movements.

The cleaning device constructed in this way functions independently, whether or not the spinning rotor is turning.

Since in the cleaning operation not only yarn residues but also impurities that are more or less stuck fast have to be removed from the spinning rotor, it is advantageous if the brush has bristles that are as firm and rigid as possible. In this case it is advantageous according to preferred embodiments of the invention, if the brush is smaller than the diameter of the open side of the spinning rotor and is disposed on a holder that is driven in a circular motion, directed concentrically with reference to the rotor. In this arrangement a movement of rotation additionally overlays the cleaning rotary motion of the brush, whereby the brush successively is presented to all important places, especially the whole extent of the yarn collecting groove of the spinning rotor.

These and further objects, features and advantages of the present invention will become more obvious from the following description when taken in connection with the accompanying drawings which show, for purposes of illustration only, multiple embodiments in accordance with the present invention.

DETAILED DESCRIPTION OF THE DRAWINGS

Figure 1:
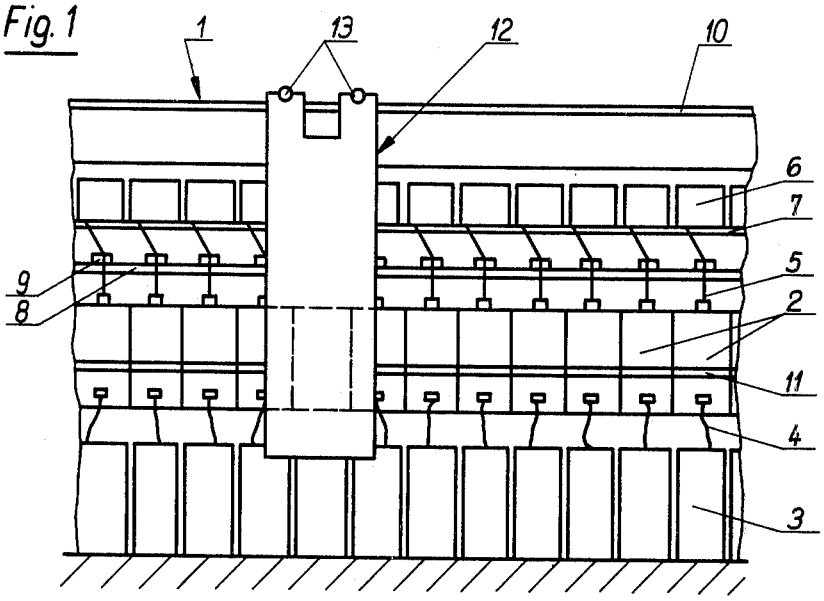
FIG. 1 is a partial sectional schematic front view of an open-end spinning frame with a traveling servicing device constructed in accordance with the present invention.

The illustrated open-end spinning frame 1 has a plurality of spinning assemblies 2 arranged side by side. A sliver 4 is fed from a can 3 to each spinning assembly 2, to be spun in a known way in spinning assembly 2 and taken off as yarn 5. The spun yarn 5 is wound on a winding bobbin 6 driven by a friction roll 7. The take off yarn 5 is effected by take off rolls 8 and 9. In order not to obscure the present invention, many details of the spinning assemblies and the servicing device are omitted in the drawings and this description. However, such details can be readily constructed by those skilled in the art of open-end spinning machines, given this disclosure and the state of the art.

There are rails 10, 11 disposed along open-end spinning frame 1, on which a servicing device 12 can be moved by means of wheels 13, whereof only the upper ones are visible in FIG. 1. Said servicing device 12 can be made as an independently traveling cleaning device, or as an instrument that in addition to other devices for execution of servicing operations has a cleaning device with appurtenant adjusting and drive means.

Figure 2:
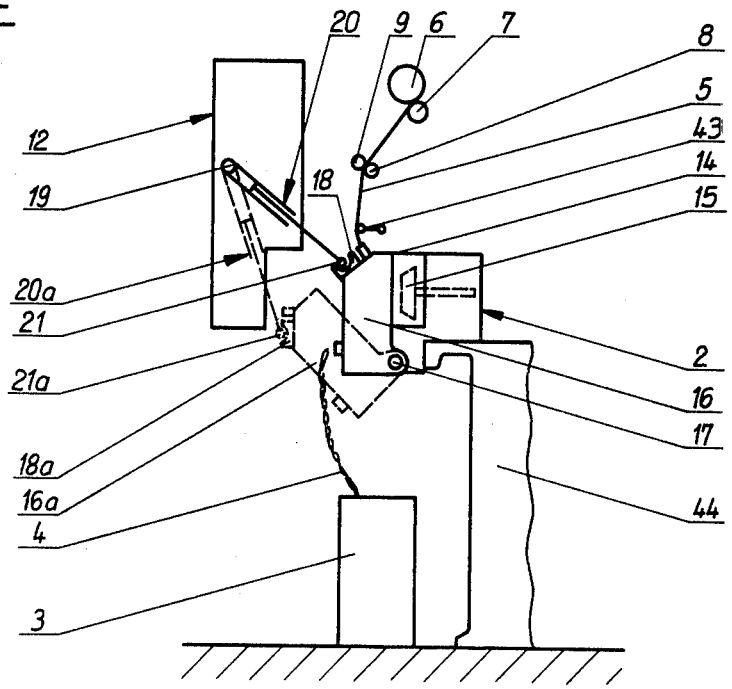
FIG. 2 is a partial cross-sectional schematic view through the open-end spinning frame of FIG. 1 with a schematic illustration of the servicing device.

In FIG. 2, servicing device 12 is shown in a servicing position at a spinning assembly 2. In the illustrated example, the spinning assembly 2 has a stationary housing 14 that is fixed on the machine frame 44 and that contains a fast running spinning rotor 15. A housing or a cover 16 of stationary housing 14 can be swung away, about a stationary shaft 17, whereby after the swinging and opening, the spinning rotor 15 is exposed. Cover 16 preferably has a feed and opening device for sliver 4. In FIG. 2, the partly pivoted cover is shown in dashed lines **16*a*. Traveling servicing device 12 is equipped with means 20 for opening swinging assembly 2, comprising a piston-cylinder unit swingable about a shaft 19, engaging with a ball 21 in a corresponding guide 18 of spinning assembly 2. After the opening, the said means assume position 20*a* (FIG. 2, dashed lines), in which, by means of ball 21*a*, the ball guide 18*a* and therewith cover 16 are held in the pivoted position 16*a***.

Figure 3:
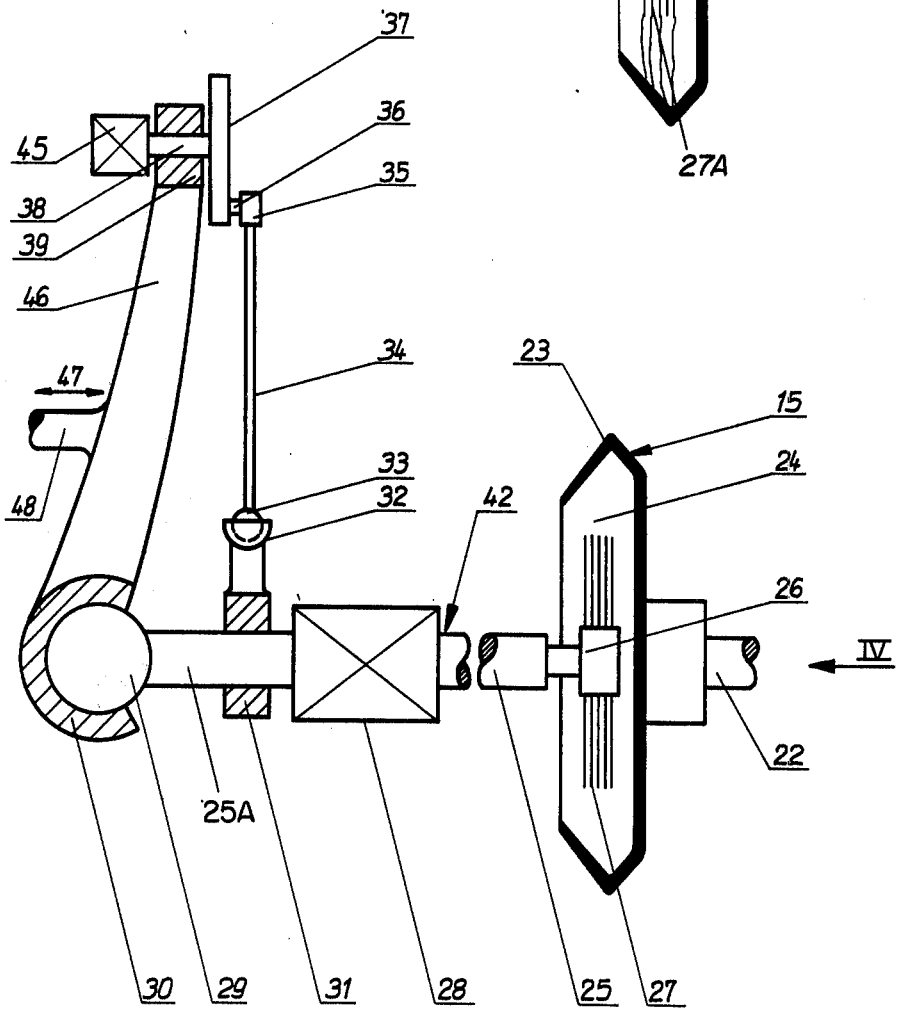
FIG. 3 is an enlarged sectional schematic view which shows a detail of the traveling servicing device of FIG. 1 in cooperation with a spinning rotor.

In FIG. 3, cover 16 and the other parts of the spinning assembly 2 other than the rotor 15, as well as the means 20 for opening the spinning assembly are not shown. Only a cleaning device 42 of traveling servicing device 12 is shown, which is illustrated as introduced right into spinning rotor 15. Spinning rotor 15, whose shaft 22 is borne in a way that is not illustrated, presents an open front side 24 and has an annular yarn collecting groove 23. In said groove 23, yarn residues remain after a spinning process is interrupted, which have to be removed from spinning rotor 15. Other impurities also have to be cleared out after a specific operation time. This cleaning process is also to be done if spinning rotor 15 is stopped.

Cleaning device 42, which is carried by and moves with the traveling servicing device 12, has a cleaning brush 27 made as a disk brush and disposed on a shaft 25 that is rotatably drivable via a motor 28, such as an electric motor. Since the external diameter of brush 27, to facilitate introduction into spinning rotor 15, is smaller than the internal diameter of open side 24 of spinning rotor 15, it is also provided that shaft 25 and the brush 51 carried thereby, will be driven to execute circular motions so that the periphery of brush 27 can reach and clean the whole yarn collecting groove 23 of spinning rotor 15. Shaft 25 and cleaning brush 27 preferably moves on a circle that is concentric to the middle of the rotor or to rotor shaft 22 (axis of shaft 22). Cleaning device 42, which is disposed as a whole on supporting arm 46, has a cam 37 at a distance from shaft 25, which cam 37 is borne by a shaft 38 in a suitable bearing 39 of supporting arm 46 and is driven at slow rotational movements by a single motor 45, such as an electric motor, possibly with interposition of a reducing gear. Via a pin 35 that is disposed on crank 36, the crank motion of cam 37 is transmitted via a rod 34 and a ball guide 32, 33 to shaft part 25A of cleaning brush 27. Shaft part 25A is held by a bearing ring 31 at rod 34 via ball guides 32, 33. To produce the circling motion of cleaning brush 27, the whole shaft 25, 25A can be moved parallel on a circular track or, as in FIG. 3 it may be swingably supported by means of a ball guide 29, 30. Ball guide 29, 30 advantageously is located along the axis of rotor shaft 22 so that the cleaning brush 27 moves on a circular path about the rotor shaft 22. Ball guide 29, 30 is also disposed on supporting arm 46. Arm 46 is carried at device 12 and is movable via a guide rod 48, more or less in the direction of double arrow 47, with slide guides that are not illustrated, so that cleaning brush 27 can be selectively introduced into or removed from spinning rotor 15. Means which are not illustrated may also be provided which effect a central introduction of brush 27 into the open side 24 of spinning rotor 15, for which, for example supporting arm 46 will be pivoted somewhat.

Figure 4:
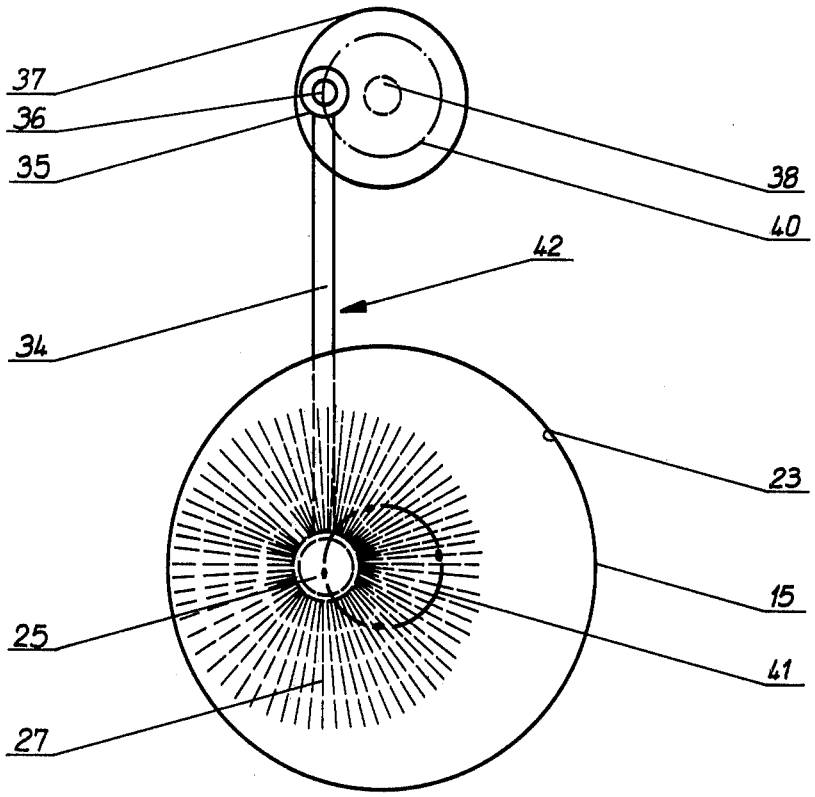
FIG. 4 is a partial schematic view in the direction of arrow IV of FIG. 3.

In FIG. 4 the yarn collection groove 23 is shown—as seen from the closed side of spinning rotor 15—said groove to be cleaned by rotating brush 27. The cleaning brush 27 executes as a whole a supplementary circular movement, on the circle 41 indicated in dot and dash lines. This circling motion that effects a movement of the brush along the whole yarn collecting groove 23 is produced by a corresponding motion 40 of crank pin 36 of cam 37. Advantageously the circulating movements (path 41 of the axis of the brush 27) of the brush are counter to the direction of its drive in rotation about its shaft 25, in preferred embodiments of the invention.

Instead of the drive shown in FIGS. 3 and 4, other drive systems are contemplated by the invention in which the cleaning brush is moved on a circular path in such a way that it would reach all zones of the yarn collecting groove of the spinning rotor. For example, the brush may be disposed on a disk or rotating crank arm. It may also be provided that the cleaning brush will not be driven as a rotary disk brush, but for example as a disk brush that moves reciprocatingly.

Figure 5:
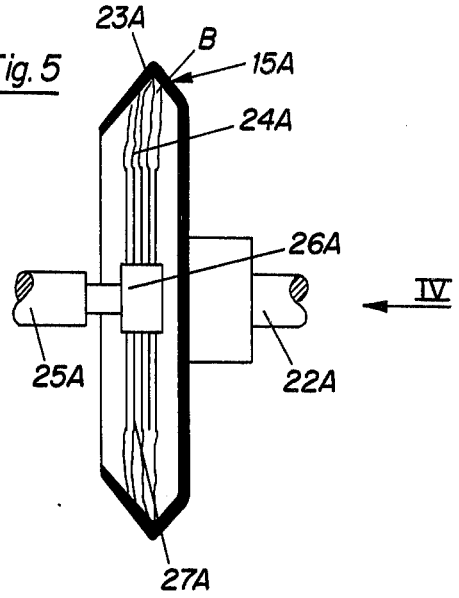
FIG. 5 is a partial schematic view of a cleaning brush arrangement constructed in accordance with another embodiment of the present invention.

FIG. 5 schematically depicts a modified arrangement with a crown of bristles B whose external diameter is at least as large as the maximum internal diameter of the spinning rotor 15A that is to be cleaned. In FIG. 5, corresponding parts of those of FIG. 3 have been designated by similar reference numerals followed by the suffix A, and accordingly further description of this embodiment should be unnecessary.

While we have shown and described various embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

I claim:

1. Cleaning apparatus for cleaning spinning rotors of open-end spining assemblies comprising:

a cleaning brush supported on a brush shaft, and drive means for drivingly moving said cleaning brush to execute rotor cleaning motions, said drive means including a rotary drive for rotatably driving said brush shaft, wherein said brush presents a crown of bristles whose external diameter is at least as large as the maximum internal diameter of the spinning rotor that is to be cleaned.

2. Apparatus according to claim 1, wherein said cleaning brush is a disk brush supported on said brush shaft.

3. Apparatus according to claim 1, further comprising cleaning brush transfer means for selectively moving said brush into and out of a penetrating position in a spinning rotor.

4. Apparatus according to claim 3, wherein said cleaning brush is a disk brush supported on said brush shaft.

5. Apparatus according to claim 3, wherein said cleaning brush, drive means, and cleaning brush transfer means are carried by a mobile servicing device which is selectively movable to servicing positions adjacent each of a plurality of open-end spinning assemblies of an open-end spinning machine, and wherein said mobile servicing device includes means for opening the spinning assemblies to make the open sides of the spinning rotors thereof accessible to the cleaning brush.

6. Apparatus according to claim 4, wherein said cleaning brush, drive means, and cleaning brush transfer means are carried by a mobile servicing device which is selectively movable to servicing positions adjacent each of a plurality of open-end spinning assemblies of an open-end spinning machine, and wherein said mobile servicing device includes means for opening the spinning assemblies to make the open sides of the spinning rotors thereof accessible to the cleaning brush.

7. Apparatus according to claim 5, wherein said mobile servicing device includes means for braking said spinning rotor during cleaning thereof by said cleaning brush.

8. Cleaning apparatus for cleaning spinning rotors of open-end spinning assemblies comprising:

a cleaning brush supported on a brush shaft, and drive means for drivingly moving said cleaning brush to execute rotor cleaning motions, said drive means including a rotary drive for rotatably driving said brush shaft, wherein the brush exhibits a smaller diameter than the diameter of the open side of the spinning rotor to be cleaned, and wherein the brush is disposed on a holder that is driven in a circular motion directed concentrically with reference to the axis of the spinning rotor, said holder being driven in said circular motion by a drive separate from said rotary drive, whereby said circular motion is superimposed on the rotary motion of said brush about an axis through said holder.

9. Apparatus according to claim 8, wherein said cleaning brush is a disk brush supported on said brush shaft.

10. Apparatus according to claim 8, further comprising cleaning brush transfer means for selectively moving said brush into and out of a penetrating position in a spinning rotor.

11. Apparatus according to claim 10, wherein said cleaning brush is a disk brush supported on said brush shaft.

12. Apparatus according to claim 10, wherein said cleaning brush, drive means, and cleaning brush transfer means are carried by a mobile servicing device which is selectively movable to servicing positions adjacent each of a plurality of open-end spinning assemblies of an open-end spinning machine, wherein said mobile servicing device includes means for opening the spinning assemblies to make the open sides of the spinning rotors thereof accessible to the cleaning brush.

13. Apparatus according to claim 11, wherein said cleaning brush, drive means, and cleaning brush transfer means are carried by a mobile servicing device which is selectively movable to servicing positions adjacent each of a plurality of open-end spinning assemblies of an open-end spinning machine, and wherein said mobile servicing device includes means for opening the spinning assemblies to make the open sides of the spinning rotors thereof accessible to the cleaning brush.

14. Apparatus according to claim 12, wherein said mobile servicing device includes means for braking said spinning rotor during cleaning thereof by said cleaning brush.

* * * * *